US008960064B2

(12) United States Patent
Supron et al.

(10) Patent No.: US 8,960,064 B2
(45) Date of Patent: Feb. 24, 2015

(54) CONFIGURABLE CUTTER MECHANISM FOR A PRINTER AND METHOD FOR CONFIGURING A CUTTER MECHANISM FOR A PRINTER

(75) Inventors: Steven A. Supron, Ithaca, NY (US); David E. Weeks, Willseyville, NY (US); Jeffrey S. Koepele, Ithaca, NY (US)

(73) Assignee: TransAct Technologies Incorporated, Hamden, CT (US)

( * ) Notice: Subject to any disclaimer, the term of this patent is extended or adjusted under 35 U.S.C. 154(b) by 205 days.

(21) Appl. No.: 13/419,516

(22) Filed: Mar. 14, 2012

(65) Prior Publication Data

US 2013/0239768 A1 Sep. 19, 2013

(51) Int. Cl.

| | |
|---|---|
| ***B26D 1/20*** | (2006.01) |
| ***B26D 1/01*** | (2006.01) |
| ***B26D 1/18*** | (2006.01) |
| ***B26D 1/24*** | (2006.01) |
| *B26D 7/00* | (2006.01) |

(52) U.S. Cl.

CPC ..... *B26D 1/015* (2013.01); *B26D 1/185* (2013.01); *B26D 1/245* (2013.01); *B26D 2007/005* (2013.01)

USPC ..... 83/508; 83/614

(58) Field of Classification Search

USPC ..... 83/508, 614

See application file for complete search history.

(56) References Cited

U.S. PATENT DOCUMENTS

| | | | | |
|---|---|---|---|---|
| 2,170,147 | A | 8/1939 | Lane | |
| 3,447,409 | A * | 6/1969 | Lewis | 83/485 |
| 4,448,101 | A * | 5/1984 | Templeton | 83/374 |
| 4,979,838 | A | 12/1990 | Yokota et al. | |
| 4,981,059 | A | 1/1991 | Kobayashi | |
| 5,174,824 | A | 12/1992 | Salancy et al. | |
| 5,243,890 | A * | 9/1993 | Ober | 83/471.2 |
| 5,531,530 | A | 7/1996 | Kuramoto et al. | |
| 5,690,437 | A | 11/1997 | Yanagisawa et al. | |
| 6,609,844 | B1 | 8/2003 | Petteruti et al. | |
| 7,588,811 | B2 | 9/2009 | Blank et al. | |
| 2007/0110493 | A1 | 5/2007 | Chen | |
| 2007/0231043 | A1 | 10/2007 | Miyashita et al. | |
| 2007/0262141 | A1 | 11/2007 | Ito et al. | |
| 2010/0139467 | A1 * | 6/2010 | Gutknecht et al. | 83/72 |

FOREIGN PATENT DOCUMENTS

| | | |
|---|---|---|
| JP | 60161851 | 8/1985 |
| JP | 05278906 | 10/1993 |

OTHER PUBLICATIONS

Pitney Bowes Brochure, Accelerated processing, Digital Mailing System with IntelliLink® Technology DM400™ Series, 4 pages, 2008.

* cited by examiner

*Primary Examiner* — Stephen Choi

(74) *Attorney, Agent, or Firm* — Lipsitz & McAllister, LLC

(57) ABSTRACT

A configurable cutter mechanism for a printer and corresponding methods are provided. The cutter mechanism may comprise a rotary cutter mounted for rotation about a rotation axis and for translation across at least a portion of a width of a paper path perpendicular to the rotation axis. A fixed blade assembly may be provided that is adapted to cooperate with the rotary cutter. The fixed blade assembly may extend across the width of the paper path. A controller may be provided for controlling a variable length of travel of the rotary cutter across the width of the paper path. The paper path runs between the rotary cutter and the fixed blade assembly.

14 Claims, 9 Drawing Sheets

CONFIGURABLE CUTTER MECHANISM FOR A PRINTER AND METHOD FOR CONFIGURING A CUTTER MECHANISM FOR A PRINTER

BACKGROUND OF THE INVENTION

The present invention relates to the field of cutter mechanisms for label and receipt printers. More specifically, the present invention relates to a cutter mechanism that can be configured based on the width of a paper roll present in the printer and corresponding methods for configuring a cutter mechanism.

Printers that print from paper rolls require a cutter to separate the printed portion from the remainder of the roll. Such printers include label printers, ticket printers, receipt printers, and the like (collectively referred to herein as "label and receipt printers"). Various types of cutters are known for label and receipt printers, including rotary or "pizza-type" cutters.

However, typical label and receipt printers are configured to accept a single size of paper roll. With such printers, there is no need to program or configure a cutter mechanism for different paper widths.

The Assignee of the present invention, TransAct Technologies Inc., is developing a printer that can be configured to accept paper rolls of different widths. Accordingly, it would be advantageous to provide a configurable cutter mechanism that can be automatically configured for cutting paper rolls of different widths. In particular, it would be advantageous to provide a cutter mechanism that can be configured to control a length of travel of a movable cutter element, such as a rotary cutter.

The methods and apparatus of the present invention provide the foregoing and other advantages.

SUMMARY OF THE INVENTION

The present invention relates to a cutter mechanism that can be configured based on the width of a paper roll present in the printer and corresponding methods for configuring a cutter mechanism.

In accordance with one example embodiment of a configurable cutter mechanism for a printer in accordance with the present invention, the cutter mechanism may comprise a rotary cutter mounted for rotation about a rotation axis and for translation across at least a portion of a width of a paper path perpendicular to the rotation axis. A fixed blade assembly may be provided that is adapted to cooperate with the rotary cutter. The fixed blade assembly may extend across the width of the paper path. A controller may be provided for controlling a variable length of travel of the rotary cutter across the width of the paper path. The paper path runs between the rotary cutter and the fixed blade assembly.

A biasing mechanism may be provided for biasing the fixed blade assembly against the rotary cutter. The biasing mechanism may comprise, for example, one or more springs, a resilient member, a counterweight, or the like.

In one example embodiment, the rotary cutter may be mounted in a pivoting printer cover together with a platen. The fixed blade assembly may be mounted in a housing of the printer. In such an example embodiment, closing of the cover clamps the paper in the paper path between the platen and a print head and biases the fixed blade assembly against the rotary cutter.

The rotary cutter may locate to a home position on one side of the paper path. The rotary cutter may translate from the home position across at least a portion of the paper path when performing a cutting operation. A blade edge of the fixed blade assembly may be configured to rise slightly from a first end to a second end of the blade edge, the first end of the blade edge corresponding to the home position of the rotary cutter. With such a configuration, as the rotary cutter translates from the home position across the paper path, due to the biasing of the rotary cutter against the fixed blade assembly, the rotary cutter depresses the fixed blade assembly during completion of the cutting operation.

A cutter home sensor may be provided for sensing when the rotary cutter is in the home position.

In a further example embodiment of the present invention, a bucket sensor may be provided in the printer which is adapted to sense at least one of insertion of a divider into a paper bucket of the printer and removal of the divider from the paper bucket and to provide a corresponding paper size signal to the controller. The controller controls the length of travel of the rotary cutter in accordance with the paper size signal from the bucket sensor. The controller may reduce the length of travel of the rotary cutter in accordance with the paper size signal when the bucket sensor senses the insertion of the divider into the paper bucket. The controller may increase the length of travel of the rotary cutter in accordance with the paper size signal when the bucket sensor senses the removal of the divider from the paper bucket.

The configurable cutter mechanism may further comprise a carriage for carrying the rotary cutter, as well as a gear, rack, and lead screw assembly for rotating and translating the rotary cutter. The rotary cutter may be rotatably mounted on the carriage. The gear may be mounted to the rotary cutter. The carriage may be mounted on the lead screw and adapted to translate along the lead screw upon rotation of the lead screw. In such an example embodiment, as the carriage translates along the lead screw, teeth of the gear contact corresponding teeth of the rack, causing the rotary cutter to rotate as the carriage translates.

In an example embodiment of a method for configuring a cutter mechanism for a printer, the method may comprise: providing a rotary cutter mounted for rotation about a rotation axis and for translation across at least a portion of a width of a paper path perpendicular to the rotation axis; providing a fixed blade assembly adapted to cooperate with the rotary cutter, the fixed blade assembly extending across the width of the paper path; and controlling a variable length of travel of the rotary cutter across the width of the paper path.

The method may also include additional features discussed above in connection with the various embodiments of the corresponding configurable cutter mechanism.

BRIEF DESCRIPTION OF THE DRAWINGS

The present invention will hereinafter be described in conjunction with the appended drawing figures, wherein like reference numerals denote like elements, and.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

Figure 1:
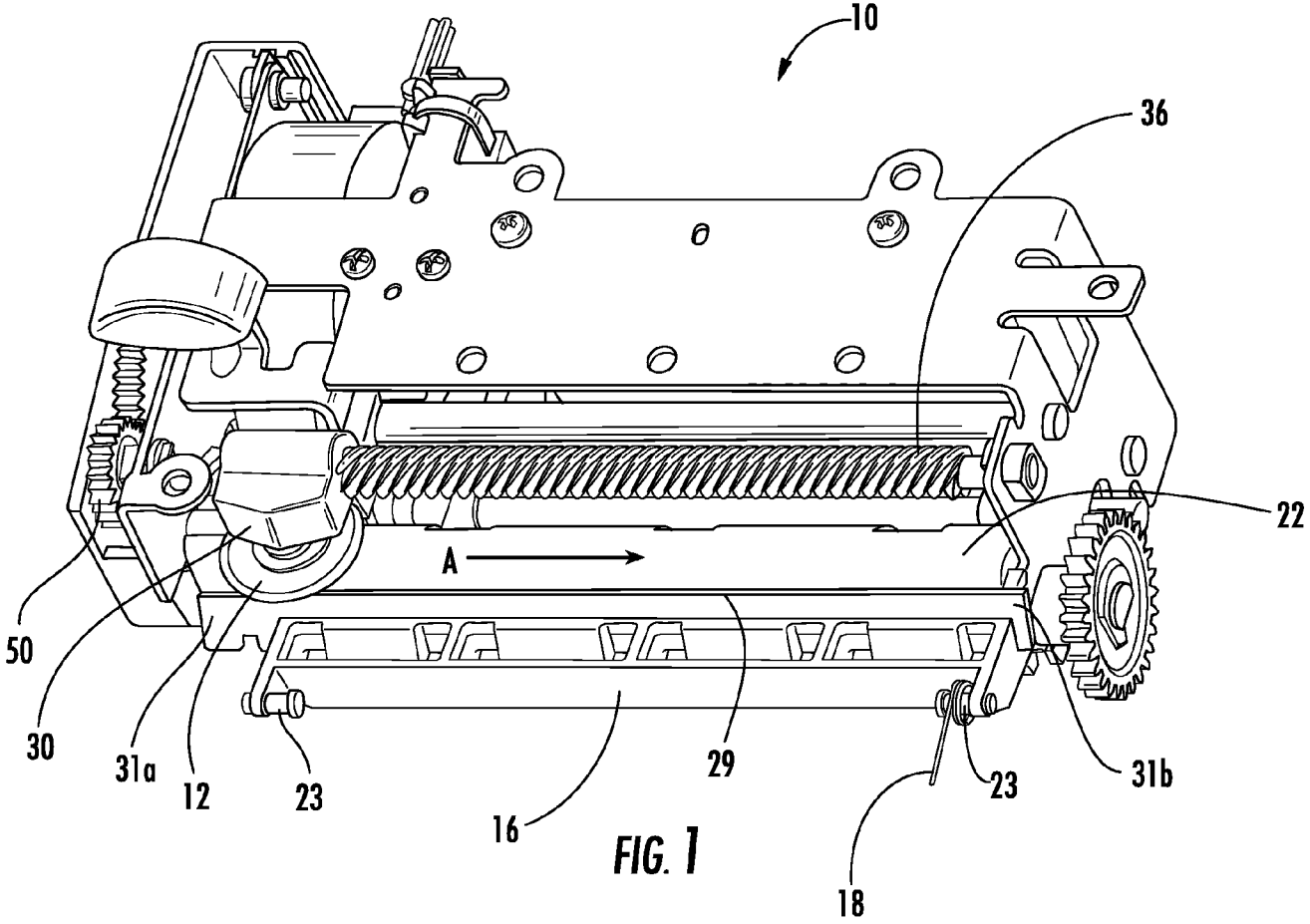
FIG. 1 shows an example embodiment of a cutter mechanism in accordance with the present invention.
Figure 2:
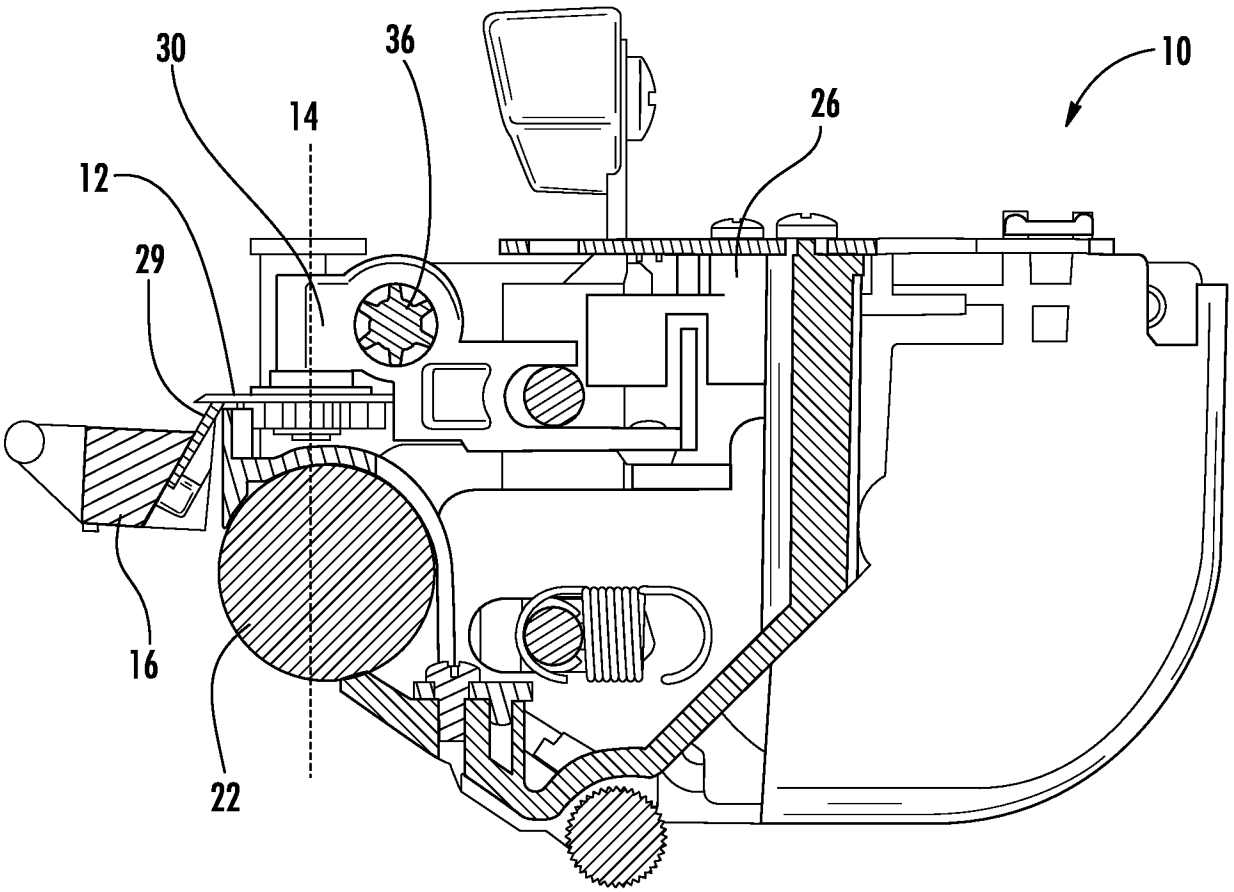
FIG. 2 shows a cutaway side view of the cutter mechanism of FIG. 1.
Figure 3:
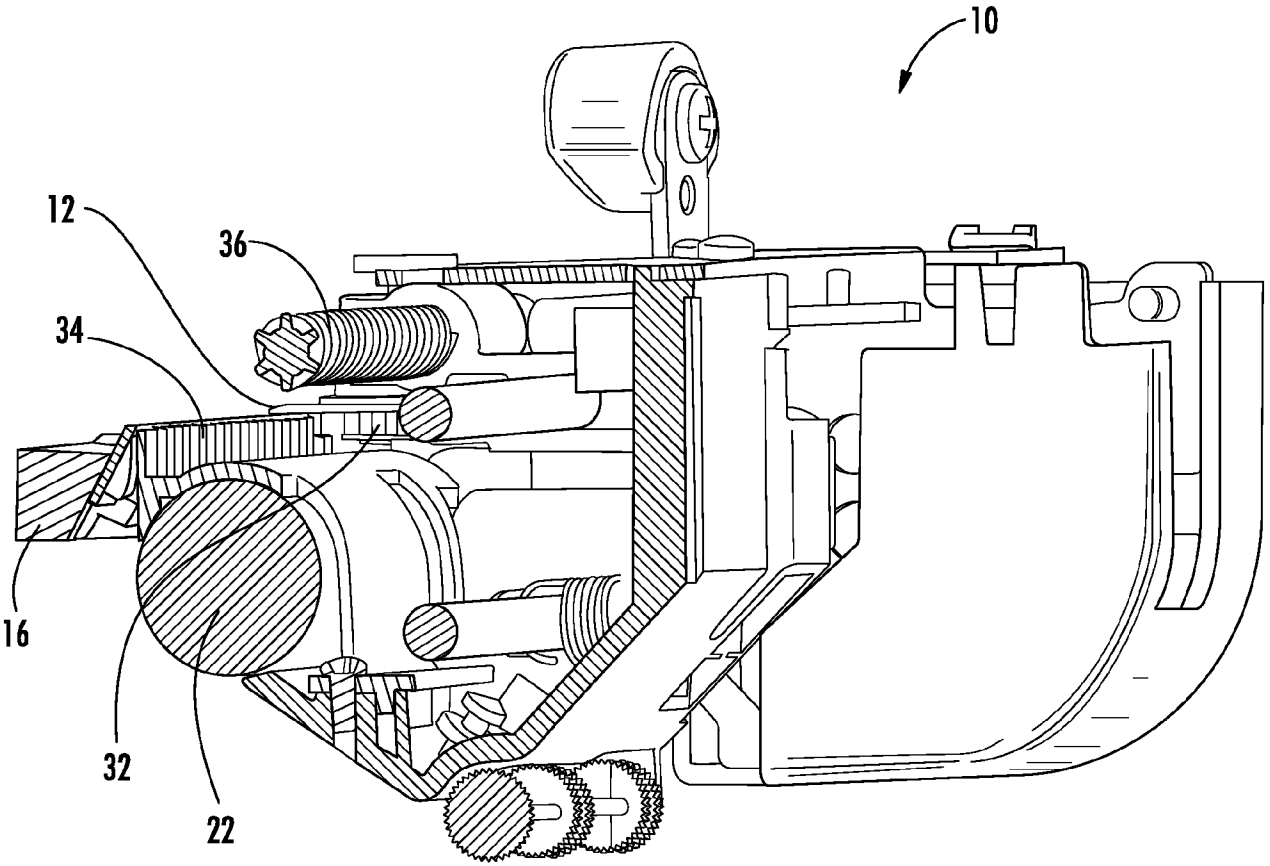
FIG. 3 shows a cutaway perspective view of the cutter mechanism of FIG. 1.

FIGS. 1-3 show one example embodiment of a configurable cutter mechanism 10 for a printer in accordance with the present invention. The cutter mechanism 10 may comprise a rotary cutter 12 mounted for rotation about a rotation axis 14 and for translation across at least a portion of a width of a paper path perpendicular to the rotation axis (e.g., a movement in a direction shown by arrow A in FIG. 1). A fixed blade assembly 16 may be provided that is adapted to cooperate with the rotary cutter 12. The fixed blade assembly 16 may extend across the width of the paper path. A controller may be provided for controlling a variable length of travel of the rotary cutter 12 across the width of the paper path. The paper path runs between the rotary cutter 12 and the fixed blade assembly 16.

The controller may be implemented on a printed circuit board 48 of the printer as discussed below in connection with FIGS. 7*a* and 7*b*.

The length of travel of the rotary cutter 12 may be controlled in dependence on the width of the paper to be cut, as discussed in more detail below. Controlling the length of travel of the rotary cutter 12 in this manner avoids unnecessary wear of the cutter blades.

A biasing mechanism 18 may be provided for biasing the fixed blade assembly 16 against the rotary cutter 12. The biasing mechanism may comprise, for example, one or more springs 18. The biasing member may also comprise a resilient member, a counterweight, or the like. The biasing mechanism 18 provides shear pressure in cooperation with the rotary cutter 12 to facilitate the cutting operation.

Figure 4:
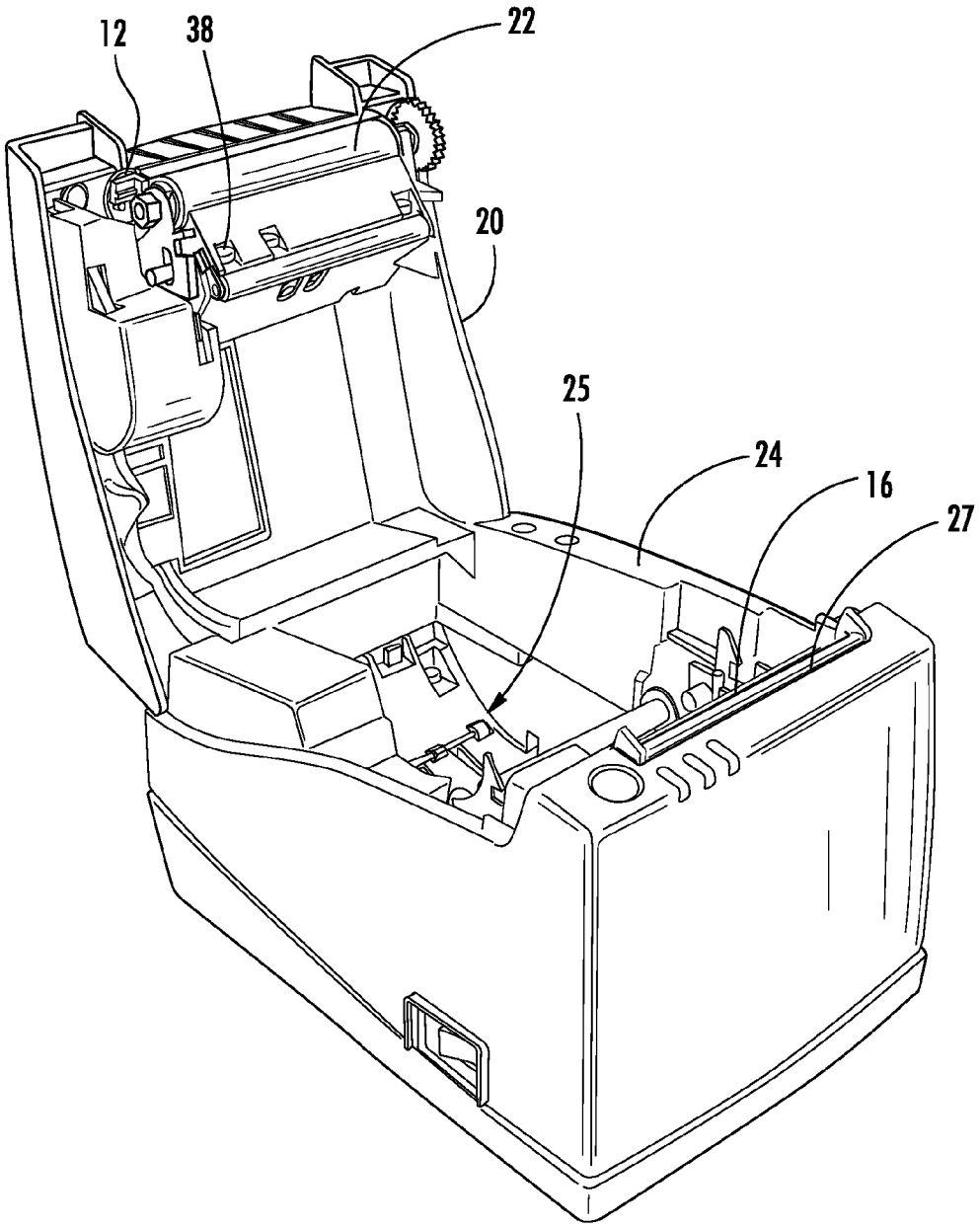
FIG. 4 shows an example embodiment of the present invention with the cutter mechanism mounted in a printer with an empty paper bucket.
Figure 5:
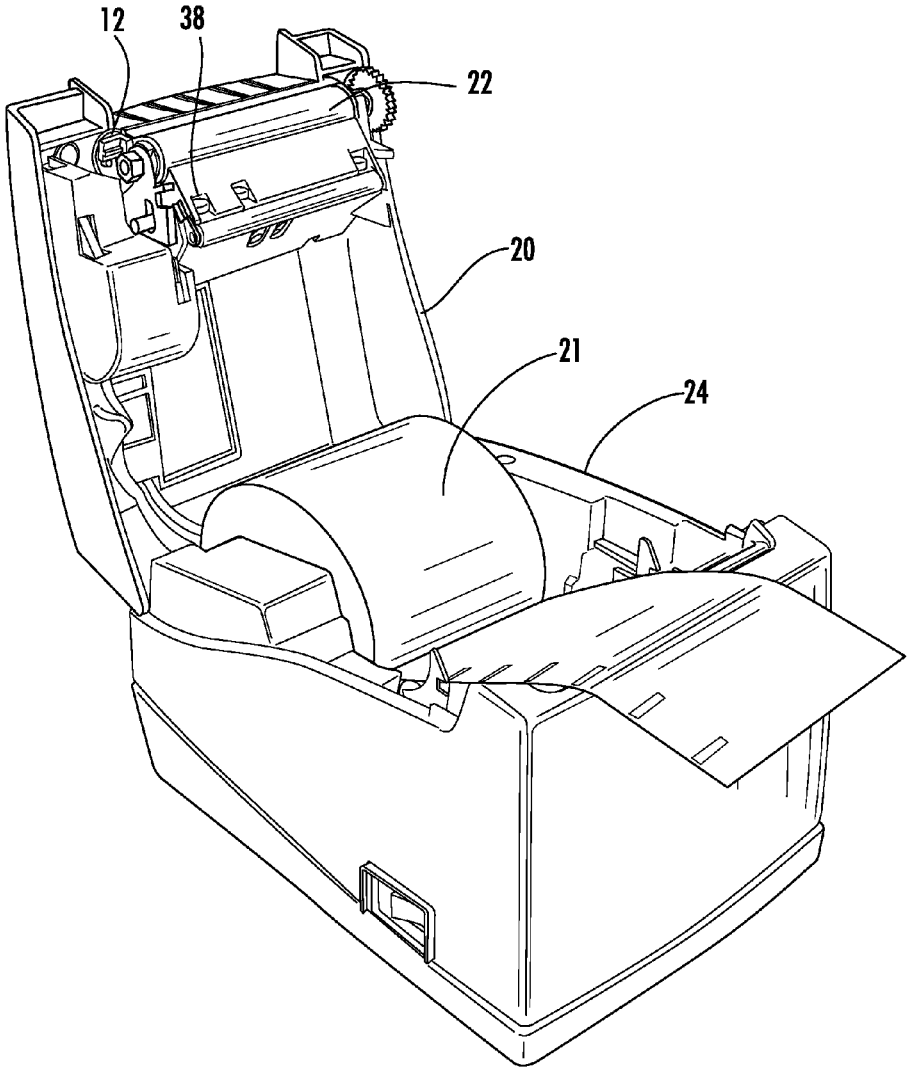
FIG. 5 shows an example embodiment of the present invention with the cutter mechanism mounted in a printer with a paper roll loaded in the paper bucket of the printer.

As shown for example in FIG. 4, the rotary cutter 12 may be mounted in a pivoting printer cover 20 together with a platen 22. The fixed blade assembly 16 may be mounted in a housing 24 of the printer. FIG. 5 shows a paper roll 21 in the paper bucket 25. As can be seen from FIG. 5, closing of the cover 20 clamps the paper 21 in the paper path between the platen 22 and a print head and biases the fixed blade 16 assembly against the rotary cutter 12.

The rotary cutter 12 may locate to a home position on one side of the paper path. For example, FIG. 1 shows the rotary cutter 12 in the home position. The rotary cutter 12 may translate from the home position across at least a portion of the paper path (in the direction of arrow A) when performing a cutting operation.

Figure 6:
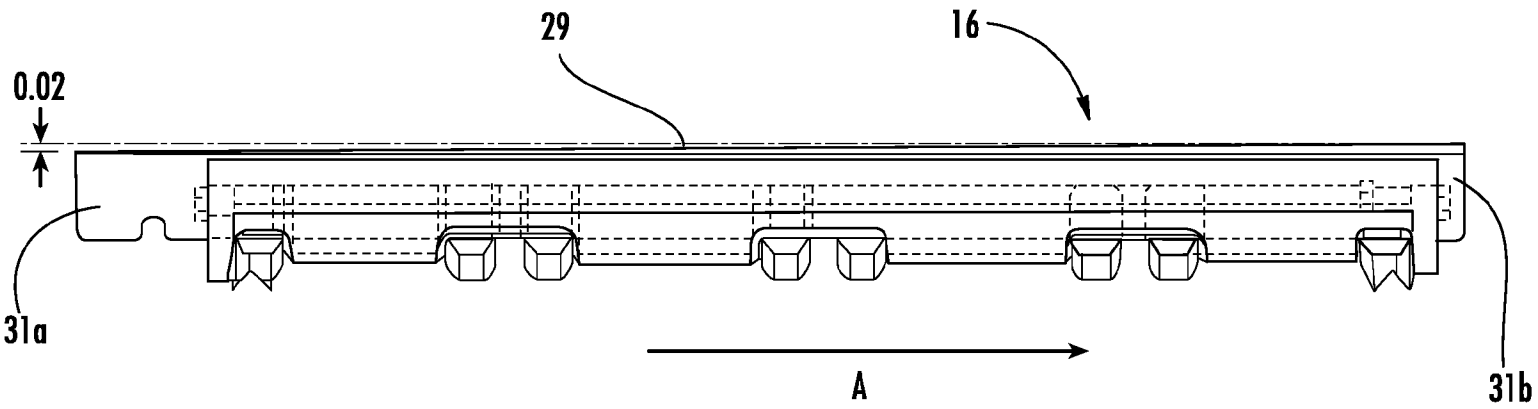
FIG. 6 shows an example embodiment of a fixed blade assembly in accordance with the present invention.

In one example embodiment, as shown in FIG. 6, a blade edge 29 of the fixed blade assembly 16 may rise slightly from a first end 31*a* to a second end 31*b* (e.g., in the direction shown by arrow A of FIG. 1) of the blade edge 29, the first end 31*a* of the blade edge 29 corresponding to the home position of the rotary cutter 12. With such a configuration, as the rotary cutter 12 translates from the home position across the paper path in the direction of arrow A, the rotary cutter 12 depresses the fixed blade assembly 16 during completion of the cutting operation. The fixed blade assembly 16 may be pivotally mounted in the housing 24 (e.g., at pivot points 23) and biased in a direction towards a tear bar 27 via biasing mechanism 18. When the cover 20 is opened, the fixed blade assembly 16 may be urged towards the tear bar 27 by the biasing mechanism 18. When the cover 20 is closed, the fixed blade assembly 16 may be depressed away from the tear bar 27 against the biasing force of the biasing mechanism 18 by contact with the rotary cutter 12 in the home position. As the rotary cutter 12 traverses across the paper path and completes a cut, due to the slight rise in the blade edge 29, the fixed blade assembly 16 is depressed additionally by the rotary cutter 12. For example, the fixed blade assembly 16 may be lowered approximately 0.02" by contact with the rotary cutter 12 due to a corresponding rise across the width of the blade edge 29. This ensures a good cutting action between the leading edge of the rotary cutter 12 and the blade edge 29 of the fixed blade assembly 16. As the rotary cutter 12 returns to the home position after completion of the cutting operation, the fixed blade assembly moves back to the original biased position. As a result, less biasing force is present on the return stroke of the rotary cutter 12, resulting in less friction and reduced wear of the blades.

This keeps the leading edge of the rotary cutter 12 in contact with the fixed blade assembly 16 during the cut, but not during the return stroke. A cutter home sensor 26 may be provided for sensing when the rotary cutter is in the home position.

Label printers may use a paper roll with glue or other adhesive on one side for printing sticky labels rather than plain thermal paper rolls. Such rolls containing adhesive may include evenly spaced apart black dots or lines denoting print areas for the sticky labels. To accommodate the use of sticky label paper rolls, a paper sensor 38 may be provided for sensing a presence of black marks (e.g., lines or dots) on the paper roll and providing a paper type signal to the controller. The controller, in response to the paper type signal indicating the presence of black marks, may at least one of decreases a print speed of the print mechanism and increases an energy of the print mechanism to better print on the sticky paper roll. For example, the second sized (smaller) paper roll may be an adhesive backed paper roll, and the black marks may denote a location of adhesive, which is positioned between the black marks. If no black marks are sensed, the print speed may be increased and the print energy may be reduced.

Figure 7A:
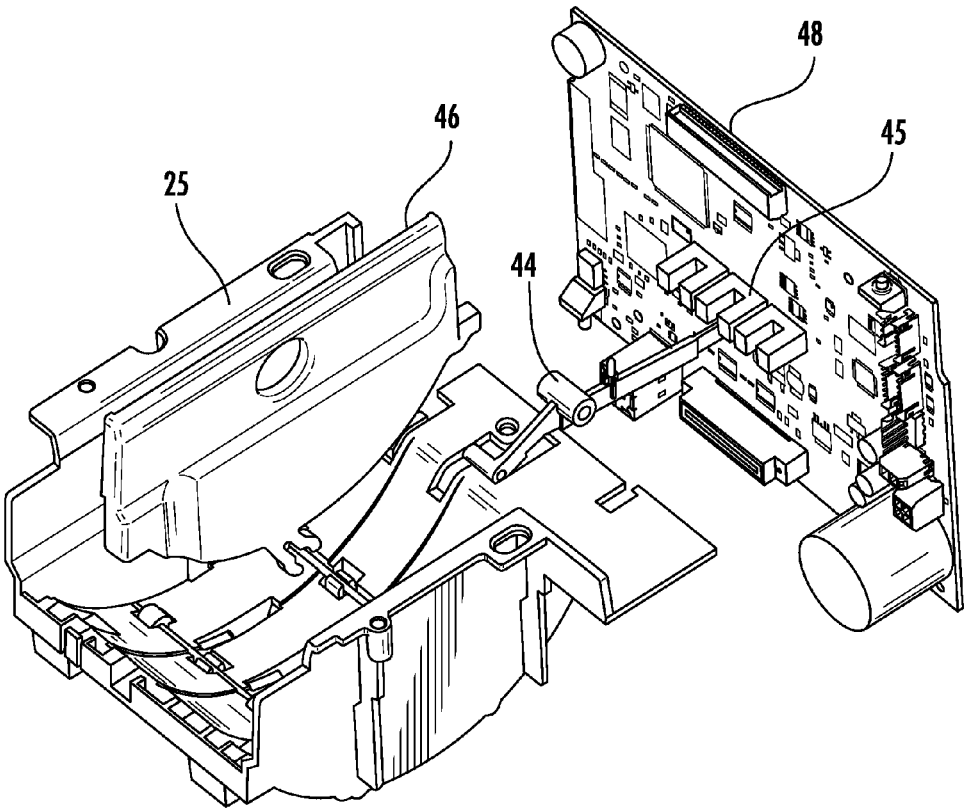
FIGS. 7*a* and 7*b* show an example embodiment of a divider and bucket sensor for configuring the cutter mechanism for different size paper rolls.
Figure 7B:
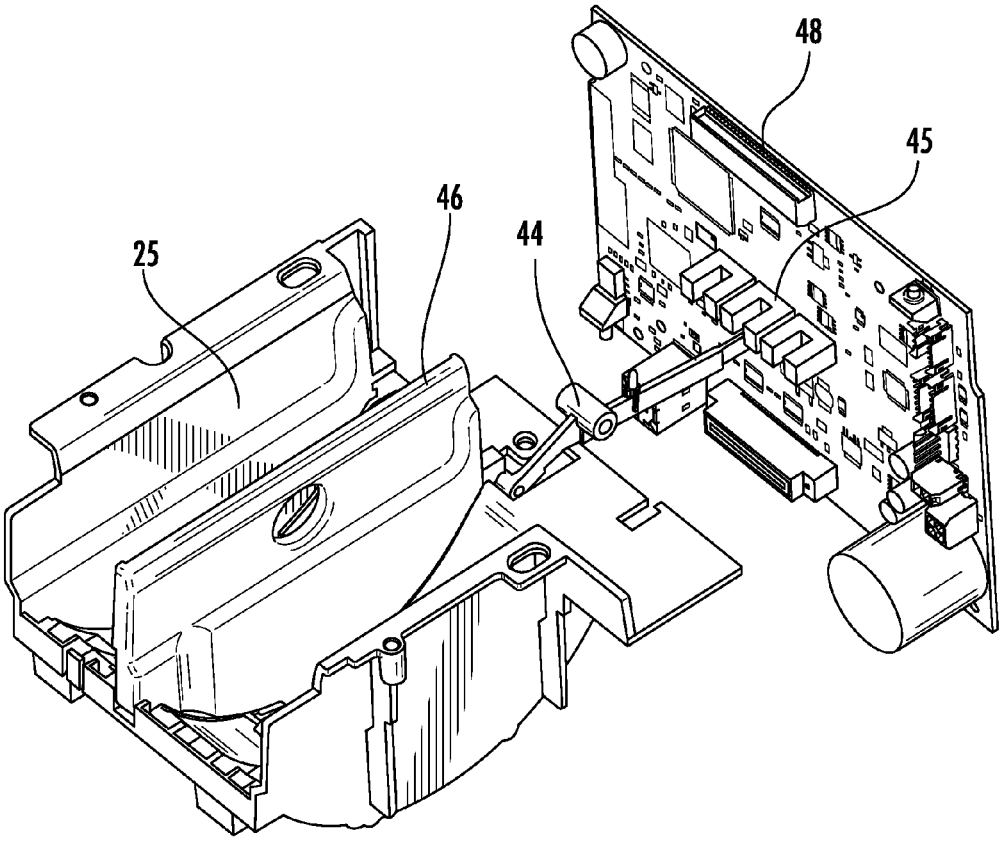

In a further example embodiment of the present invention, as shown in FIGS. 7*a* and 7*b*, a flag 44 and corresponding bucket sensor 45 may be provided in the printer which are adapted to sense at least one of insertion of a divider 46 into a paper bucket 25 of the printer and removal of the divider 46 from the paper bucket 25. The sensor 45 provides a corresponding paper size signal to the controller. The paper bucket 25 is adapted to hold a large paper roll (e.g., an 80 mm paper roll) and the divider 46 is used to adapt the paper bucket 25 to hold a smaller paper roll (e.g., a 40 mm paper roll). The controller may be implanted in circuitry provided on a printed circuit board (PCB) 48 of the printer. The flag 44 interacts with the bucket sensor 45, which is implemented on the PCB 48. The sensor 45 may be a slotted sensor as shown in FIGS. 7*a* and 7*b*. One end of flag 44 may move into position between slots of the sensor 45 to trip or interrupt the sensor 45. The other end of the flag 44 may be acted on by the divider 46 when inserted into bucket 25. The controller controls the length of travel of the rotary cutter 12 in accordance with the paper size signal from the bucket sensor 45. The controller may reduce the length of travel of the rotary cutter 12 in accordance with the paper size signal when the bucket sensor 45 senses the insertion of the divider into the paper bucket 25. The controller may increase the length of travel of the rotary cutter 12 in accordance with the paper size signal when the bucket sensor 45 senses the removal of the divider from the paper bucket 25.

For example, FIG. 7*a* shows the divider 46 either just after removal from or just prior to insertion in the paper bucket 25. When the divider 46 is not inserted into position in the paper bucket 25, the flag 44 does not trigger the bucket sensor 45 (e.g., as shown in FIG. 7*a*, the flag 44 is not depressed by a corresponding portion of the divider 46), and via the paper size signal, the rotary cutter 12 is configured to travel across the full paper path of the printer. FIG. 7*b* shows the divider 46 completely inserted into the paper bucket 25 and depressing the flag 44, triggering the bucket sensor 45. In this position, the length of travel of the rotary cutter 12 is reduced to conform to the smaller width of the smaller paper roll.

Although FIGS. 7*a* and 7*b* show a flag-type bucket sensor 45, those skilled in the art will appreciate that other types of sensors may also be used to detect the presence of the divider 46, such as an optical sensor, a hall effect sensor, a mechanical switch, a magnetic switch, various configurations of the flag-type sensor, or the like. It is also possible for the divider 25 to be configured to directly trigger the slotted sensor 45.

As an example, paper rolls having widths of either 40 mm or 80 mm are typically used in label and receipt printers. The bucket sensor 45 senses the size of the paper roll and controls the movement of the cutter accordingly. Partial or full cuts of the paper roll can be selected. For example, if a 40 mm paper roll is sensed, the controller may limit the cutter to a paper path that is 39 columns long and if an 80 mm paper roll is sensed, the controller may limit the cutter to a paper path that is 79 columns long, resulting in a partial cut of the paper roll (a full cut corresponding to a 40 or 80 column paper path for the 40 and 80 mm rolls, respectively). The cutter mechanism may be controlled such that a full cut is completed at selected intervals (e.g., every third or fifth cut).

Figure 8:
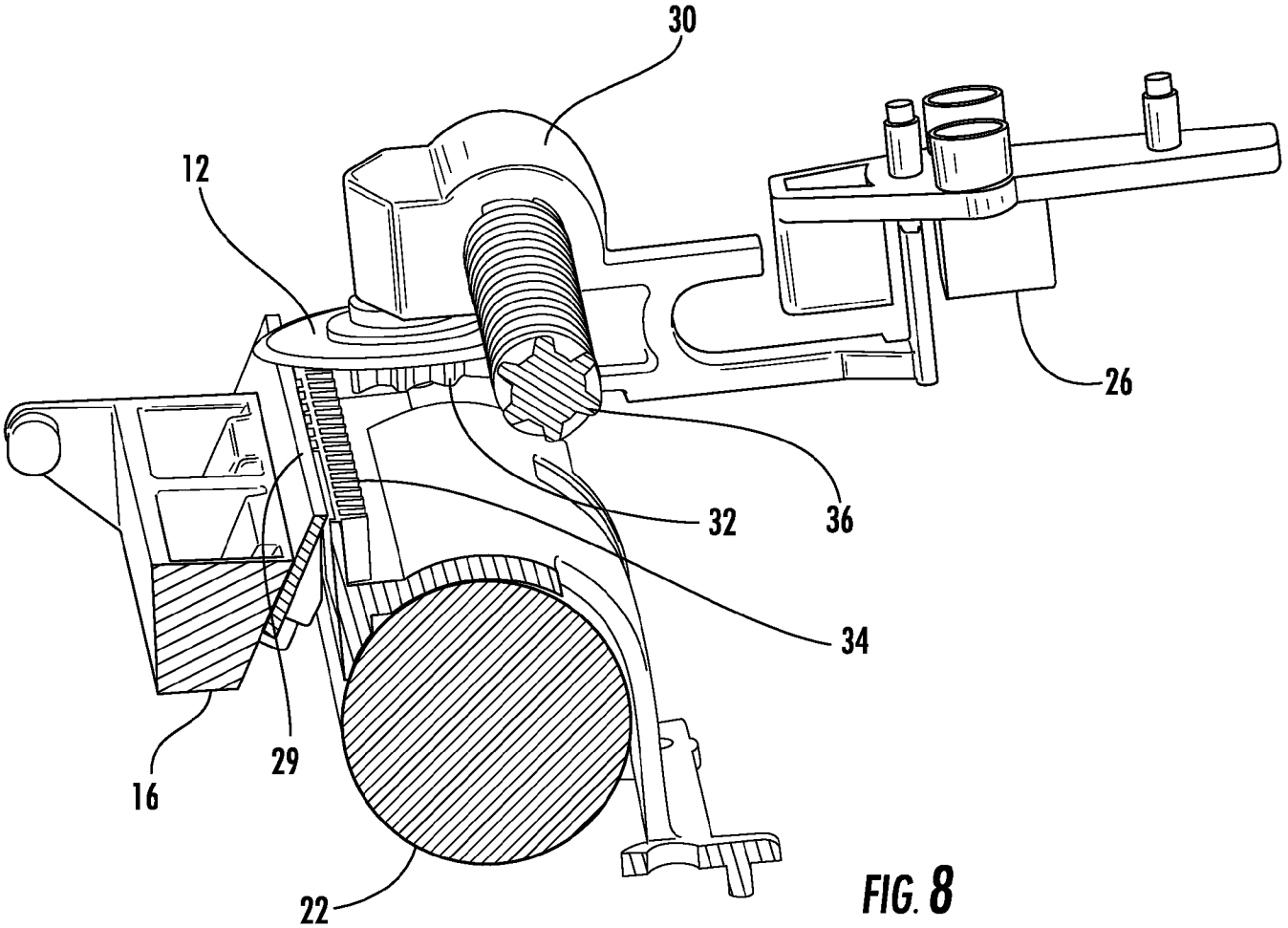
FIG. 8 shows an example embodiment of a gear, rack and lead screw assembly for the rotary cutter in accordance with the present invention.

As shown in FIG. 8, the configurable cutter mechanism 10 may further comprise a carriage 30 for carrying the rotary cutter 12, as well as a gear, rack, and lead screw assembly (e.g., gear 32, rack 34, and lead screw 36) for rotating and translating the rotary cutter 12. The rotary cutter 12 may be rotatably mounted on the carriage 30. The gear 32 may be mounted to the rotary cutter 12. The carriage 30 may be mounted on the lead screw 36 and adapted to translate along the lead screw 36 upon rotation of the lead screw 36. In such an example embodiment, as the carriage 30 translates along the lead screw 36, teeth of the gear 32 contact corresponding teeth of the rack 34, causing the rotary cutter 12 to rotate as the carriage 30 translates. A stepper motor (not shown) may be used to rotate the lead screw 36 via a gear drive 50 (shown in FIG. 1).

It should now be appreciated that the present invention provides an advantageous configurable cutter mechanism for receipt and label printers which can be used with different sized paper rolls, as well as corresponding methods for configuring a cutter mechanism for cutting different sized paper rolls.

Although the invention has been described in connection with various illustrated embodiments, numerous modifications and adaptations may be made thereto without departing from the spirit and scope of the invention as set forth in the claims.

What is claimed is:

1. A configurable cutter mechanism for a printer, comprising:

a rotary cutter mounted for rotation about a rotation axis and for translation across at least a portion of a width of a paper path perpendicular to the rotation axis, the rotary cutter locating to a home position on one side of the paper path;

a fixed blade assembly adapted to cooperate with the rotary cutter, the fixed blade assembly extending across the width of the paper path;

a controller for controlling a variable length of travel of the rotary cutter across the width of the paper path;

a biasing mechanism for biasing the fixed blade assembly against the rotary cutter such that a blade edge of the fixed blade assembly rises slightly from a first end to a second end of the blade edge, the first end of the blade edge corresponding to the home position of the rotary cutter;

wherein:

the paper path runs between the rotary cutter and the fixed blade assembly;

the rotary cutter translates from the home position across at least a portion of the paper path when performing a cutting operation;

the biasing mechanism is positioned only at an end of the fixed blade assembly opposite the home position; and as the rotary cutter translates from the home position across the paper path, the rotary cutter depresses the fixed blade assembly during completion of the cutting operation.

2. The configurable cutter mechanism in accordance with claim 1, wherein:

the rotary cutter is mounted in a pivoting printer cover together with a platen;

the fixed blade assembly is mounted in a housing of the printer; and closing of the cover clamps the paper in the paper path between the platen and a print head and biases the fixed blade assembly against the rotary cutter.

3. The configurable cutter mechanism in accordance with claim 1, further comprising:

a cutter home sensor for sensing when the rotary cutter is in the home position.

4. The configurable cutter mechanism in accordance with claim 1, wherein:

a bucket sensor is provided in the printer which is adapted to sense at least one of insertion of a divider into a paper bucket of the printer and removal of the divider from the paper bucket and to provide a corresponding paper size signal to the controller; and the controller controls the length of travel of the rotary cutter in accordance with the paper size signal from the bucket sensor.

5. The configurable cutter mechanism in accordance with claim 4, wherein the controller reduces the length of travel of the rotary cutter in accordance with the paper size signal when the bucket sensor senses the insertion of the divider into the paper bucket.

6. The configurable cutter mechanism in accordance with claim 4, wherein the controller increases the length of travel of the rotary cutter in accordance with the paper size signal when the bucket sensor senses the removal of the divider from the paper bucket.

7. The configurable cutter mechanism in accordance with claim 1, further comprising:

a carriage for carrying the rotary cutter;

a gear, rack, and lead screw assembly for rotating and translating the rotary cutter;

wherein:

the rotary cutter is rotatably mounted on the carriage;

the gear is mounted to the rotary cutter;

the carriage is mounted on the lead screw and adapted to translate along the lead screw upon rotation of the lead screw; and as the carriage translates along the lead screw, teeth of the gear contact corresponding teeth of the rack, causing the rotary cutter to rotate as the carriage translates.

8. A method for configuring a cutter mechanism for a printer, comprising:

providing a rotary cutter mounted for rotation about a rotation axis and for translation across at least a portion of a width of a paper path perpendicular to the rotation axis;

locating the rotary cutter to a home position on one side of the paper path prior to performing a cutting operation;

providing a fixed blade assembly adapted to cooperate with the rotary cutter, the fixed blade assembly extending across the width of the paper path;

controlling a variable length of travel of the rotary cutter across the width of the paper path;

biasing the fixed blade assembly against the rotary cutter via a biasing mechanism such that a blade edge of the fixed blade assembly rises slightly from a first end to a second end of the blade edge, the first end of the blade edge corresponding to the home position of the rotary cutter;

wherein:

the paper path runs between the rotary cutter and the fixed blade assembly;

the rotary cutter translates from the home position across at least a portion of the paper path when performing the cutting operation;

the biasing mechanism is positioned only at an end of the fixed blade assembly opposite the home position; and as the rotary cutter translates from the home position across the paper path, the rotary cutter depresses the fixed blade assembly during completion of the cutting operation.

9. The method in accordance with claim 8, wherein:

the rotary cutter is mounted in a pivoting printer cover together with a platen;

the fixed blade assembly is mounted in a housing of the printer; and closing of the cover clamps the paper in the paper path between the platen and a print head and biases the fixed blade assembly against the rotary cutter.

10. The method in accordance with claim 8, further comprising:

sensing when the rotary cutter is in the home position.

11. The method in accordance with claim 8, further comprising:

sensing at least one of insertion of a divider into a paper bucket and removal of the divider from the paper bucket via a bucket sensor;

providing a corresponding paper size signal from the bucket to the controller;

wherein the controller controls the length of travel of the rotary cutter in accordance with the paper size signal from the bucket sensor.

12. The method in accordance with claim 11, wherein the controller reduces the length of travel of the rotary cutter in accordance with the paper size signal when the bucket sensor senses the insertion of the divider into the paper bucket.

13. The method in accordance with claim 11, wherein the controller increases the length of travel of the rotary cutter in accordance with the paper size signal when the bucket sensor senses the removal of the divider from the paper bucket.

14. The method in accordance with claim 8, further comprising:

providing a carriage for carrying the rotary cutter;

providing a gear, rack, and lead screw assembly for rotating and translating the rotary cutter;

wherein:

the rotary cutter is rotatably mounted on the carriage;

the gear is mounted to the rotary cutter;

the carriage is mounted on the lead screw and adapted to translate along the lead screw upon rotation of the lead screw; and as the carriage translates along the lead screw, teeth of the gear contact corresponding teeth of the rack, causing the rotary cutter to rotate as the carriage translates.

* * * * *